US010544648B2

(12) United States Patent
Costa De Oliveira et al.

(10) Patent No.: US 10,544,648 B2
(45) Date of Patent: Jan. 28, 2020

(54) SYSTEMS AND METHODS FOR SEALING A WELLBORE

(71) Applicant: Saudi Arabian Oil Company, Dhahran (SA)

(72) Inventors: Victor Carlos Costa De Oliveira, Dhahran (SA); Ramon Rodriguez Rico, Dhahran (SA); Khaled K. Abouelnaaj, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 232 days.

(21) Appl. No.: 15/485,842

(22) Filed: Apr. 12, 2017

(65) Prior Publication Data

US 2018/0298717 A1 Oct. 18, 2018

(51) Int. Cl.

| | |
|---|---|
| ***E21B 33/128*** | (2006.01) |
| ***E21B 47/06*** | (2012.01) |
| ***E21B 47/12*** | (2012.01) |

(52) U.S. Cl.

CPC ..... *E21B 33/1285* (2013.01); *E21B 47/06* (2013.01); *E21B 47/12* (2013.01)

(58) Field of Classification Search

CPC ..... E21B 33/1285; E21B 33/1291; E21B 33/1295; E21B 33/12955; E21B 47/06; E21B 47/12

See application file for complete search history.

(56) References Cited

U.S. PATENT DOCUMENTS

| | | | |
|---|---|---|---|
| 1,812,044 | A | 6/1931 | Grant |
| 3,335,801 | A | 8/1967 | Wilsey |
| 3,557,875 | A | 1/1971 | Solum et al. |

(Continued)

FOREIGN PATENT DOCUMENTS

| | | |
|---|---|---|
| CN | 204177988 | 2/2015 |
| EP | 377234 | 10/1989 |

(Continued)

OTHER PUBLICATIONS

International Patent Office Communication (Invitation to Pay Additional Fees and, where Applicable, Protest Fee, PCT Article 17(3)a and Rule 40.1 and Rule 40.2e) issued in International Application No. PCT/US2018/027038 dated Sep. 26, 2018, 13 pages.

(Continued)

*Primary Examiner* — Caroline N Butcher
(74) *Attorney, Agent, or Firm* — Fish & Richardson P.C.

(57) ABSTRACT

Systems and methods for sealing a wellbore are described. The system includes a packing element configured to at least partially seal an uphole portion of a wellbore from a downhole portion of the wellbore. A first annular pressure sensor is positioned uphole of the packing element. The first annular pressure sensor is configured to measure a first pressure within the wellbore uphole of the packing element. A second annular pressure sensor is positioned downhole of the packing element. The second annular pressure sensor is configured to measure a second pressure within the wellbore downhole of the packing element. A control sub-assembly is configured to be positioned within the wellbore. The control sub-assembly is configured to monitor a sealing efficiency of the system by comparing the first pressure and the second pressure.

23 Claims, 7 Drawing Sheets

(56) References Cited

U.S. PATENT DOCUMENTS

| | | | |
|---|---|---|---|
| 4,058,163 | A | 11/1977 | Yandell |
| 4,252,195 | A | 2/1981 | Fredd |
| 4,384,625 | A | 5/1983 | Roper et al. |
| 4,399,873 | A | 8/1983 | Lindsey, Jr. |
| 4,458,761 | A | 7/1984 | Van Vreeswyk |
| 4,482,014 | A | 11/1984 | Allwin et al. |
| 4,646,842 | A | 3/1987 | Arnold et al. |
| 4,674,569 | A | 6/1987 | Revils et al. |
| 4,681,159 | A | 7/1987 | Allwin et al. |
| 4,693,328 | A | 9/1987 | Furse et al. |
| 4,852,654 | A | 8/1989 | Buckner |
| 4,855,820 | A | 8/1989 | Barbour |
| 4,944,348 | A | 7/1990 | Whiteley et al. |
| 4,993,493 | A | 2/1991 | Arnold |
| 5,152,342 | A | 10/1992 | Rankin et al. |
| 5,390,742 | A | 2/1995 | Dines et al. |
| 5,831,156 | A | 11/1998 | Mullins |
| 5,875,852 | A | 3/1999 | Floyd et al. |
| 5,947,213 | A | 9/1999 | Angle |
| 6,009,948 | A | 1/2000 | Flanders et al. |
| RE36,556 | E | 2/2000 | Smith |
| 6,152,221 | A | 11/2000 | Carmicheal et al. |
| 6,163,257 | A | 12/2000 | Tracy |
| 6,234,250 | B1 | 5/2001 | Green et al. |
| 6,378,628 | B1 | 4/2002 | McGuire et al. |
| 6,527,066 | B1 | 3/2003 | Rives |
| 6,550,534 | B2 | 4/2003 | Brett |
| 6,577,244 | B1 | 6/2003 | Clark et al. |
| 6,588,505 | B2 | 7/2003 | Beck et al. |
| 6,662,110 | B1 | 12/2003 | Bargach et al. |
| 6,684,953 | B2 | 2/2004 | Sonnier |
| 6,691,779 | B1 | 2/2004 | Sezginer et al. |
| 6,739,398 | B1 | 5/2004 | Yokley et al. |
| 6,752,216 | B2 | 6/2004 | Coon |
| 6,873,267 | B1 | 3/2005 | Tubel et al. |
| 6,899,178 | B2 | 5/2005 | Tubel |
| 6,938,698 | B2 | 9/2005 | Coronado |
| 7,219,730 | B2 | 5/2007 | Tilton et al. |
| 7,228,902 | B2 | 6/2007 | Oppelt |
| 7,243,735 | B2 | 7/2007 | Koederitz et al. |
| 7,252,152 | B2 | 8/2007 | LoGiudice et al. |
| 7,278,492 | B2 | 10/2007 | Braddick |
| 7,419,001 | B2 | 9/2008 | Broussard |
| 7,581,440 | B2 | 9/2009 | Meek |
| 7,654,334 | B2 | 2/2010 | Manson |
| 7,665,537 | B2 | 2/2010 | Patel et al. |
| 7,677,303 | B2 | 3/2010 | Coronado |
| 7,938,192 | B2 | 5/2011 | Rytlewski |
| 7,940,302 | B2 | 5/2011 | Mehrotra et al. |
| 8,028,767 | B2 | 10/2011 | Radford et al. |
| 8,102,238 | B2 | 1/2012 | Golander et al. |
| 8,191,635 | B2 | 6/2012 | Buske et al. |
| 8,237,585 | B2 | 8/2012 | Zimmerman |
| 8,334,775 | B2 | 12/2012 | Tapp et al. |
| 8,424,605 | B1 | 4/2013 | Schultz et al. |
| 8,448,724 | B2 | 5/2013 | Buske et al. |
| 8,469,084 | B2 | 6/2013 | Clark et al. |
| 8,528,668 | B2 | 9/2013 | Rasheed |
| 8,540,035 | B2 | 9/2013 | Xu et al. |
| 8,750,513 | B2 | 6/2014 | Renkis |
| 8,789,585 | B2 | 7/2014 | Leising et al. |
| 8,800,655 | B1 | 8/2014 | Bailey |
| 8,833,472 | B2 | 9/2014 | Hay |
| 8,919,431 | B2 | 12/2014 | Lott |
| 8,925,213 | B2 | 1/2015 | Sallwasser |
| 8,991,489 | B2 | 3/2015 | Redlinger et al. |
| 9,051,792 | B2 | 6/2015 | Herberg et al. |
| 9,091,148 | B2 | 7/2015 | Moffitt et al. |
| 9,121,255 | B2 | 9/2015 | Themig et al. |
| 9,140,100 | B2 | 9/2015 | Daccord et al. |
| 9,157,294 | B2 | 10/2015 | Kleppa et al. |
| 9,187,959 | B2 | 11/2015 | Treviranus et al. |
| 9,208,676 | B2 | 12/2015 | Fadell et al. |
| 9,341,027 | B2 | 5/2016 | Radford et al. |
| 9,494,003 | B1 | 11/2016 | Carr |
| 9,506,318 | B1 | 11/2016 | Brunet |
| 9,546,536 | B2 | 1/2017 | Schultz et al. |
| 2002/0148607 | A1 | 10/2002 | Pabst |
| 2003/0001753 | A1 | 1/2003 | Cernocky et al. |
| 2004/0060741 | A1 | 4/2004 | Shipalesky et al. |
| 2004/0156264 | A1* | 8/2004 | Gardner ..... E21B 47/122 367/81 |
| 2005/0273302 | A1 | 12/2005 | Huang et al. |
| 2006/0081375 | A1 | 4/2006 | Ruttley |
| 2006/0086497 | A1 | 4/2006 | Ohmer et al. |
| 2006/0107061 | A1 | 5/2006 | Holovacs |
| 2006/0260799 | A1 | 11/2006 | Broussard |
| 2006/0290528 | A1 | 12/2006 | MacPherson et al. |
| 2007/0057811 | A1 | 3/2007 | Mehta |
| 2007/0107911 | A1 | 5/2007 | Miller et al. |
| 2007/0187112 | A1 | 8/2007 | Eddison et al. |
| 2007/0261855 | A1 | 11/2007 | Brunet |
| 2008/0041631 | A1 | 2/2008 | Vail, III |
| 2008/0115574 | A1 | 5/2008 | Meek |
| 2009/0045974 | A1 | 2/2009 | Patel |
| 2009/0050333 | A1 | 2/2009 | Smith |
| 2009/0114448 | A1 | 5/2009 | Laird et al. |
| 2009/0223670 | A1 | 9/2009 | Snider |
| 2009/0289808 | A1 | 11/2009 | Prammer |
| 2010/0097205 | A1 | 4/2010 | Script |
| 2010/0101786 | A1 | 4/2010 | Lovell et al. |
| 2010/0212891 | A1 | 8/2010 | Stewart et al. |
| 2010/0212900 | A1 | 8/2010 | Eddison et al. |
| 2010/0212901 | A1 | 8/2010 | Buytaert |
| 2010/0258298 | A1 | 10/2010 | Lynde et al. |
| 2010/0282511 | A1 | 11/2010 | Maranuk et al. |
| 2011/0067884 | A1 | 3/2011 | Burleson et al. |
| 2011/0073329 | A1 | 3/2011 | Clemens et al. |
| 2011/0127044 | A1 | 6/2011 | Radford et al. |
| 2011/0147014 | A1 | 6/2011 | Chen et al. |
| 2011/0240302 | A1 | 10/2011 | Coludrovich, III |
| 2011/0266004 | A1 | 11/2011 | Hallundbaek et al. |
| 2012/0085540 | A1 | 4/2012 | Heijnen |
| 2012/0175135 | A1 | 7/2012 | Dyer et al. |
| 2012/0241154 | A1 | 9/2012 | Zhou |
| 2012/0247767 | A1 | 10/2012 | Themig et al. |
| 2012/0307051 | A1 | 12/2012 | Welter |
| 2012/0312560 | A1 | 12/2012 | Bahr et al. |
| 2013/0128697 | A1 | 5/2013 | Contant |
| 2013/0153245 | A1 | 6/2013 | Knobloch et al. |
| 2014/0060844 | A1 | 3/2014 | Barbour et al. |
| 2014/0083769 | A1 | 3/2014 | Moriarty et al. |
| 2014/0090898 | A1 | 4/2014 | Moriarty et al. |
| 2014/0126330 | A1 | 5/2014 | Shampine et al. |
| 2014/0139681 | A1 | 5/2014 | Jones, Jr. et al. |
| 2014/0166367 | A1 | 6/2014 | Campbell et al. |
| 2014/0172306 | A1 | 6/2014 | Brannigan |
| 2014/0208847 | A1 | 7/2014 | Baranov |
| 2014/0308203 | A1 | 10/2014 | Sheinberg et al. |
| 2015/0027706 | A1 | 1/2015 | Symms |
| 2015/0090459 | A1 | 4/2015 | Cain et al. |
| 2015/0152713 | A1 | 6/2015 | Garcia et al. |
| 2015/0176362 | A1 | 6/2015 | Prieto et al. |
| 2015/0267500 | A1 | 9/2015 | Van Dongen et al. |
| 2015/0308203 | A1 | 10/2015 | Lewis |
| 2016/0160578 | A1 | 6/2016 | Lee |
| 2016/0215612 | A1 | 7/2016 | Morrow |
| 2016/0230508 | A1 | 8/2016 | Jensen |
| 2016/0237764 | A1 | 8/2016 | Jellison et al. |
| 2016/0237768 | A1 | 8/2016 | Jamison et al. |
| 2016/0245039 | A1* | 8/2016 | Goodman ..... E21B 33/129 |
| 2016/0356152 | A1 | 12/2016 | Croux |
| 2017/0074071 | A1 | 3/2017 | Tzallas et al. |
| 2018/0030810 | A1 | 2/2018 | Saldanha |

FOREIGN PATENT DOCUMENTS

| | | |
|---|---|---|
| EP | 618345 | 10/1994 |
| EP | 2692982 | 5/2014 |
| EP | 2835493 | 2/2015 |
| GB | 2157743 | 10/1985 |
| GB | 2261238 | 12/1993 |
| GB | 2460096 | 11/2009 |
| GB | 2470762 | 12/2010 |

(56) References Cited

FOREIGN PATENT DOCUMENTS

| | | | | |
|---|---|---|---|---|
| WO | 2003058545 | | 7/2003 | |
| WO | 2011038170 | | 3/2011 | |
| WO | 2011095600 | | 8/2011 | |
| WO | 2011159890 | | 12/2011 | |
| WO | 2015169959 | | 11/2015 | |
| WO | WO-2015169959 | A2 * | 11/2015 | ..... E21B 33/127 |
| WO | 2016060658 | | 4/2016 | |
| WO | WO-2016060658 | A1 * | 4/2016 | ..... E21B 23/06 |

OTHER PUBLICATIONS

International Search Report and Written Opinion issued in International Application No. PCT/US2018/027038 dated Jan. 23, 2019, 22 pages.

Offshore, "Completions Technology: Large monobore completions prevent high-volume gas well flow restrictions", Dec. 1, 2001, retrieved from the internet: • http://www.offshore-mag.com/articles/print/volume-61/issue-12/news/completions-technology-large-monobore-completions-prevent-high-volume-gas-well-flow-restrictions.html, 9 pages.

Engineers Edge—ACME Stub Threads Size Designation Table Chart, retrieved from the internet at: http://www.engineersedge.com/hardware/acme-stub-thread.htm, retrieved Feb. 27, 2017, 2 pages.

Engineering Innovation Worldwide, TIW XPAK Liner Hanger System brochure, 2015 TIW Corporation, Houston TX , TIW0001D 06/15, retrieved form the internet at: http://www.tiwoiltools.com/Images/Interior/downloads/tiw_xpak_brochure.pdf, 4 pages.

Mi Swaco: A Schlumberger Company, "Intelligent Fluids Monitoring System," available on or before Mar. 11, 2015, [retrieved May 1, 2018] retrieved from URL: <https://www.slb.com/resources/other_resources/brochures/miswaco/intelligent_fluids_monitoring_brochure.aspx>, 8 pages.

* cited by examiner

SYSTEMS AND METHODS FOR SEALING A WELLBORE

TECHNICAL FIELD

This specification relates to wellbore packers, for example, monitoring sealing efficiencies of wellbore packers.

BACKGROUND

When working on a wellbore, the wellbore sometimes needs to be sealed for extended periods of time. The seal often needs to be maintained for an extended period of time to prevent injury to workers or an environmental release. In such a situation, packers can be deployed to seal the wellbore. A packer can seal the wellbore with an elastomer seal that extends radially outward from a cylindrical core to seal against the wall of a wellbore.

SUMMARY

This specification describes technologies relating to sealing a wellbore. This specification also describes technologies for monitoring sealing efficiencies of wellbore packers.

Certain aspects of the subject matter described here can be implemented as a wellbore monitoring system. The system includes a packing element configured to at least partially seal an uphole portion of a wellbore from a downhole portion of the wellbore. A first annular pressure sensor is positioned uphole of the packing element. The first annular pressure sensor is configured to measure a first pressure within the wellbore uphole of the packing element. A second annular pressure sensor is positioned downhole of the packing element. The second annular pressure sensor is configured to measure a second pressure within the wellbore downhole of the packing element. A control sub-assembly is configured to be positioned within the wellbore. The control sub-assembly is configured to monitor a sealing efficiency of the system by comparing the first pressure and the second pressure.

With or without any of the other aspects, the system can include a cylindrical body that supports the packing element, the first annular pressure sensor, the second annular pressure sensor and the control sub-assembly. A first packer slip can be positioned nearer an uphole end of the cylindrical body than a downhole end of the cylindrical body. The first packer slip can at least partially support the system. A second packer slip can be positioned nearer the downhole end of the cylindrical body than the uphole end of the cylindrical body. The second packer slip can at least partially support the system.

With or without any of the other aspects, the packing element can be positioned between the first packer slip and the second packer slip. With or without any of the other aspects, the control-subassembly can include one or more processors and a computer-readable medium storing instructions executable by the one or more processors to perform operations. The operations can include receiving, from a surface of the wellbore, instructions to perform sealing operations within the wellbore, and transmitting to the control sub-assembly at least a portion of the sealing instructions. The packing element can at least partially seal the wellbore in response to the sealing instructions.

With or without any of the other aspects, the operations can include receiving, from at least one of annular pressure sensors, status signals representing a sealing status of the packing element, and transmitting, to the surface of the wellbore, the status signals.

With or without any of the other aspects, the status signals can include a state of the system, which can include either an engaged or a disengaged state. An engaged state can include the first slip being in an extended position, the second slip being in an extended position, or the packing element being in an extended position extending from the cylindrical body to a wall of the wellbore. A disengaged state can include the first packing slip, the second packing slip, the packing element to not extend from the cylindrical body to the wall of the wellbore.

With or without any of the other aspects, the system can include one or more transmitters at the surface of the wellbore that can transmit the sealing instructions to the one or more processors. The system can include one or more receivers at the surface of the wellbore that can receive the status signals from the one or more processors.

With or without any of the other aspects, the one or more transmitters and the one or more receivers can be configured to communicate wireless with the one or more processors.

With or without any of the other aspects, the system can include one or more repeaters that can be positioned between the surface and the control sub-assembly within the wellbore, and that can boost a strength of a wireless signal between the one or more transmitters or the one or more receivers and the one or more processors.

With or without any of the other aspects, the control-subassembly can include a power source that can be positioned within the wellbore, that can be operatively coupled to the one or more processors and that can provide operating power to the one or more processors.

With or without any of the other aspects, the system can include a hydraulic power unit that can be operatively coupled to the one or more processors, and that can receive at least the portion of the instructions from the one or more processors.

With or without any of the other aspects, the hydraulic power unit can include a hydraulic pump fluidically connected to the system, and that can supply hydraulic fluid at a pressure sufficient to activate the system.

Certain aspects of the subject matter described here can be implemented as a method of sealing a wellbore. A control sub-assembly deployed within a wellbore receives sealing instructions to perform sealing operations within the wellbore from a surface of the wellbore. The control assembly transmits at least a portion of the sealing instructions to a packer sub-assembly that includes a cylindrical body, a first packer slip positioned nearer an uphole end of the cylindrical body than a downhole end of the cylindrical body, a second packer slip positioned nearer the downhole end of the cylindrical body than the uphole end of the cylindrical body, a packing element positioned between the first packer slip and the second packer slip, a first annular pressure sensor positioned uphole of the packing element, and a second annular pressure sensor positioned downhole of the packing element. Each of the first uphole packer slip and the second packer slip can at least partially support the packer sub-assembly. The packing elements can at least partially seal the wellbore. The first annular pressure sensor and the second annular pressure sensor can measure a first pressure and a second pressure, respectively, within the wellbore uphole of and downhole of, respectively, of the packing element. The packer sub-assembly is activated to at least partially seal the wellbore. An effectiveness of the seal is determined by comparing the first pressure and the second pressure.

With or without any of the other aspects, the packer sub-assembly can transmit status signals representing a status of the packer sub-assembly to the control assembly. The control assembly can receive status signals from the packer sub-assembly.

With or without any of the other aspects, the control assembly can transmit the status signals from the packer sub-assembly to the surface of the wellbore.

With or without any of the other aspects, the packer sub-assembly can include a hydraulic unit that includes a hydraulic pump. To activate the first packer slip, the second packer slip, and the packing element to at least partially seal the wellbore, the hydraulic pump can pump hydraulic fluid to mechanically activate the first packer slip, the second packer slip or the packing element.

Certain aspects of the subject matter described here can be implemented as a method. To form a bottom hole assembly that can be deployed in a wellbore to seal the wellbore, a control assembly and a packer sub-assembly can be assembled. The control assembly includes one or more processors and a computer-readable medium storing instructions executable by the one or more processors to seal the wellbore. The packer sub-assembly can seal the wellbore. The bottom hole assembly is deployed in the wellbore. From a surface of the wellbore, the control subassembly controls the packer sub-assembly using wireless signals to seal the wellbore.

With or without any of the other aspects, the control assembly can receive status signals representing a status of sealing operations from the packer sub-assembly. The control assembly can wirelessly transmit the status signals to the surface of the wellbore.

With or without any of the other aspects, the status signals can include a state of the packer sub-assembly. The state can include either an on state or an off state, and a hydraulic pressure of the packer sub-assembly.

With or without any of the other aspects, the status signals can include a pressure differential across the packer sub-assembly.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Production and injection wellbores often need to be sealed for maintenance or repair operations. Such repairs and maintenance can include replacing damaged casing, replacing damaged tubing, inspecting well components, or any other necessary operation. During such operations, the wellbore can be sealed to allow safe access to the section of the wellbore requiring attention. The seal can help prevent environmental releases, fires, explosions, asphyxiation, and any other potential hazard resulting from a hydrocarbon release.

Certain operations can require a seal to be in place and secured for an extended period of time. During that time, the seal integrity should be monitored to ensure that there is no hydrocarbon release. Monitoring the seal integrity can be difficult, and the likelihood of a seal failure increases with the amount of time the seal is in place.

A packer can be used to provide the necessary seal during repair and maintenance operations, but a standard packer can be difficult to set and can often take multiple attempts to provide a proper seal. Testing the seal between each attempt can be cumbersome and time consuming. Often times a packer is "dumb". That is, the packer is incapable of monitoring its own sealing integrity. As such, auxiliary equipment is often needed to monitor the sealing integrity of a packer.

This specification discusses a smart packer that can be included in a completion or testing string that is meant to alleviate such issues. The smart packer includes a battery pack to power the unit, a control unit to control the packer, a rubber packing element to seal a drilling annulus, upper and lower pressure sensors to ensure the integrity/seal of the rubber element, and upper and lower set of slips to anchor the packer to the walls of a wellbore. The smart packer communicates wirelessly with the surface and is able to transmit data in real time. The smart packer is capable of actuating (for example, engaging and disengaging) it slips and rubber elements multiple times before needing to be retrieved. The smart packer eliminates risks such as, prematurely setting or releasing due to differential pressures while circulating, losses or uncontrolled manipulation of the pipe. The setting mechanism ensures the proper setting force is delivered to the packing element (also known as packing rubber element or packer rubber element) to guarantee the zonal isolation, and eliminate the slick line operations. The smart packer can be used in a vertical, horizontal, or deviated wellbore.

Figure 1:
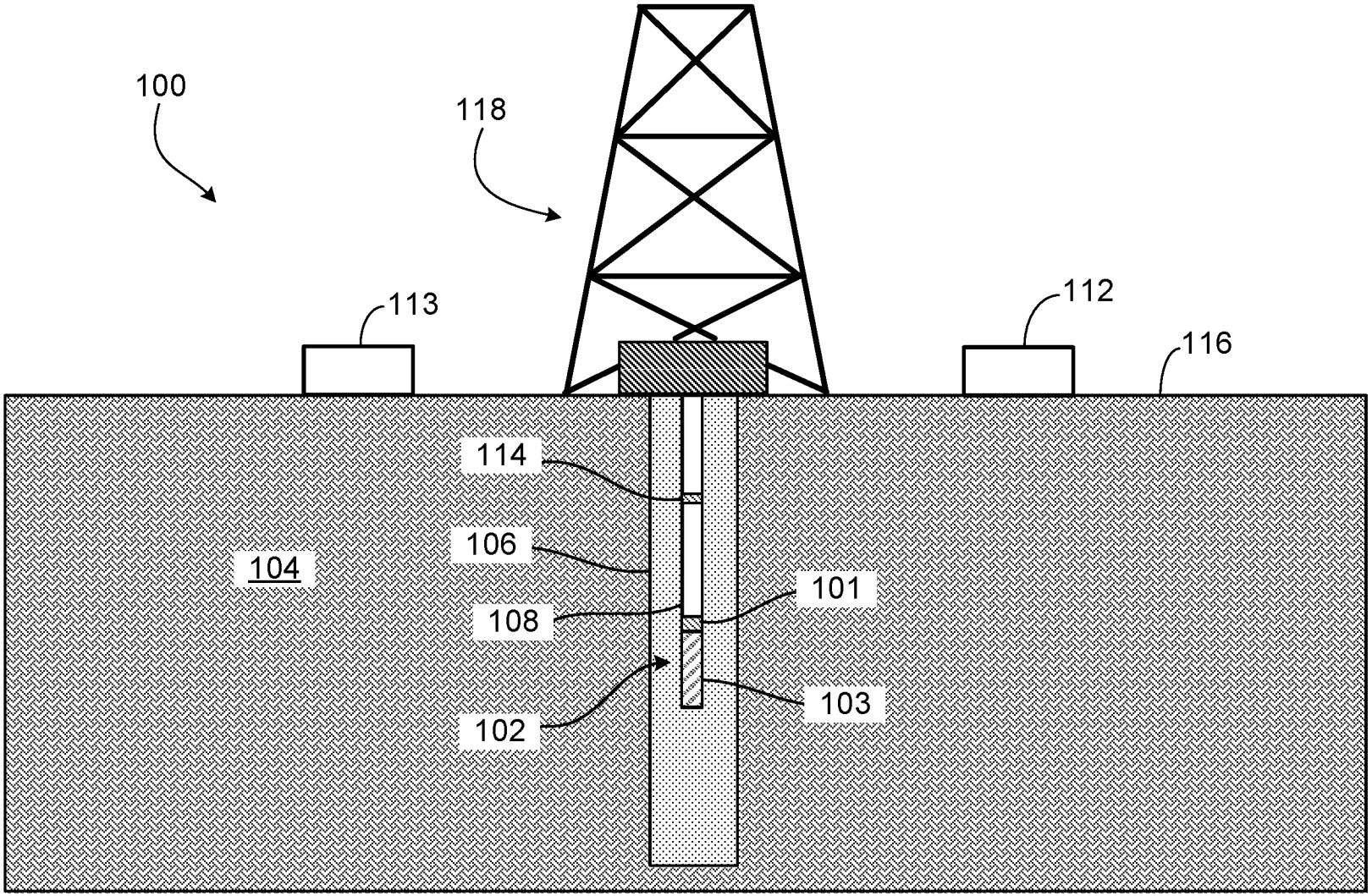
FIG. 1 is a side cross-sectional view of an example wellbore being sealed.

FIG. 1 shows an example cross-sectional view of a packer installation system 100. The packer installation system 100 can include a derrick 118 that can support a completion or testing string 108 within a wellbore 106 that has been formed in a geologic formation 104. While the illustrated implementation shows deployment of the bottom hole assembly 102 via the derrick 118 and the string 108, a coiled tubing set-up can also be used to deploy the bottom hole assembly 102. A bottom hole assembly 102 is positioned at the downhole end of the string 108 and can include a control sub-assembly 101 and a packer sub-assembly 103. The control sub-assembly 101 can be mounted on and carried by the bottom hole assembly and can monitor a sealing efficiency of the packer installation system 100. The packer sub-assembly 103 is explained in greater detail later in the specification.

At the surface 116, a transmitter 113 and a receiver 112 can be positioned to communicate with the control sub-assembly 101. The packer installation system 100 can also include one or more repeaters 114 that can be positioned between the surface 116 and the bottom hole assembly 102 within the wellbore 106. The one or more repeaters 114 can boost a strength of a wireless signal between the control sub-assembly 101 and the surface 116.

Figure 2:
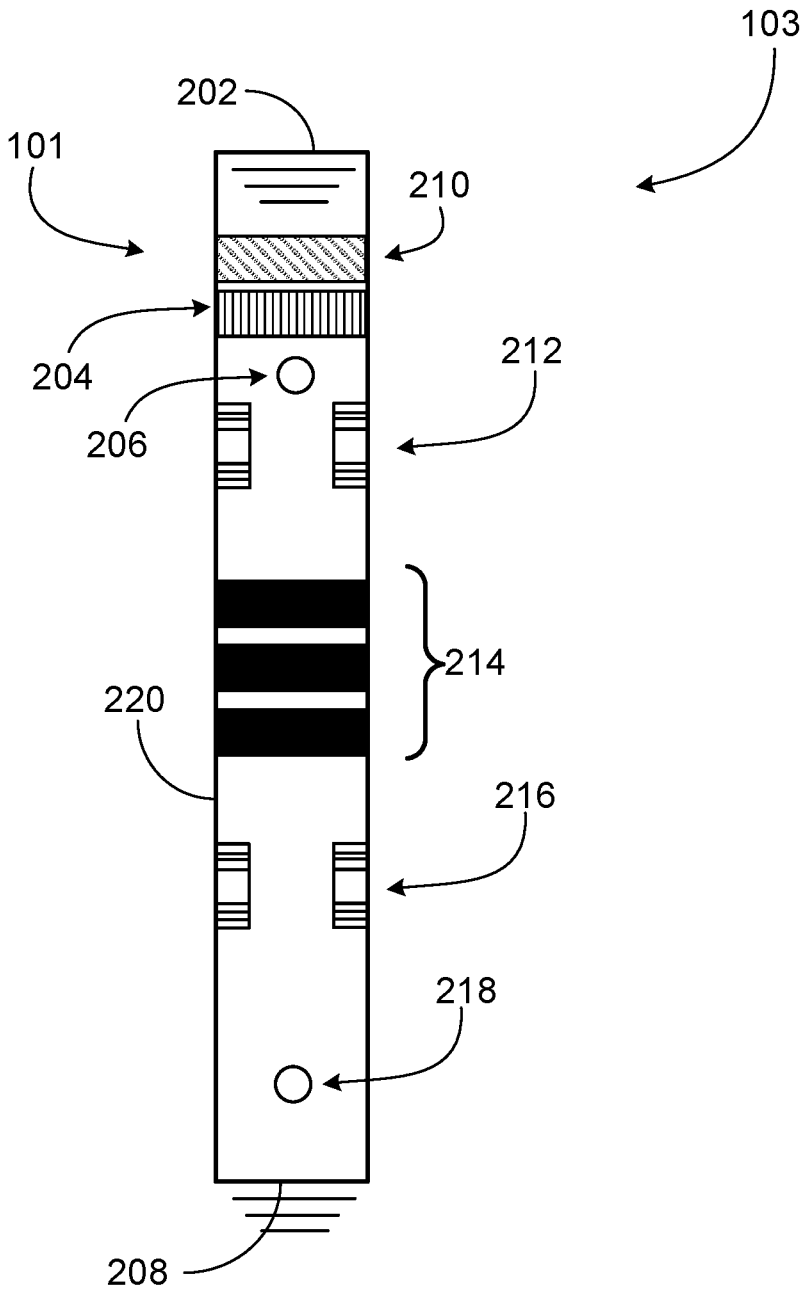
FIG. 2 is a side view of an example packer sub-assembly.

FIG. 2 shows a schematic diagram of an example packer sub-assembly 103. In the illustrated example, the packer sub-assembly includes a cylindrical body with a first packer slip 212 nearer the uphole end 202 of the packer sub-assembly 103 than the downhole end 208 of the packer sub-assembly 103. The first packer slip 212 can at least partially support the packer sub-assembly 103 within the wellbore 106. A second packer slip 216 is positioned nearer the downhole end 208 of the packer sub-assembly 103 than the uphole end 202 of the packer sub-assembly 103. The second packer slip 216 can at least partially support the packer sub-assembly 103 within the wellbore 106. While the illustrated implementation includes a first packer slip 212 and a second packer slip 216, a different number of packer slips (fewer or more) can be used. For example, a single packer slip or three packer slips could be used. In the illustrated implementation, a packing element 214 is positioned nearer the center of the cylindrical body 220 than either end of the cylindrical body 220. The packing element can at least partially seal a wellbore 106.

A first annular pressure sensor 206 is positioned uphole of the packing element 214 and measures a pressure within the wellbore 106 uphole of the packing element 214. A second annular pressure sensor 218 is positioned downhole of the packing element 214 and measures a pressure in the wellbore downhole of the packing element 214. Each pressure sensor can be fixedly attached to the cylindrical body 220 of the packer sub-assembly 103. While the illustrated implementation shows a single packing element and two pressure sensors, additional packing elements and sensors may be used. For example, if monitor seal is required, an additional packing element and sensor could be added. The additional sensor can monitor a pressure between the two packing elements while the packer sub assembly is in place.

Figure 3:
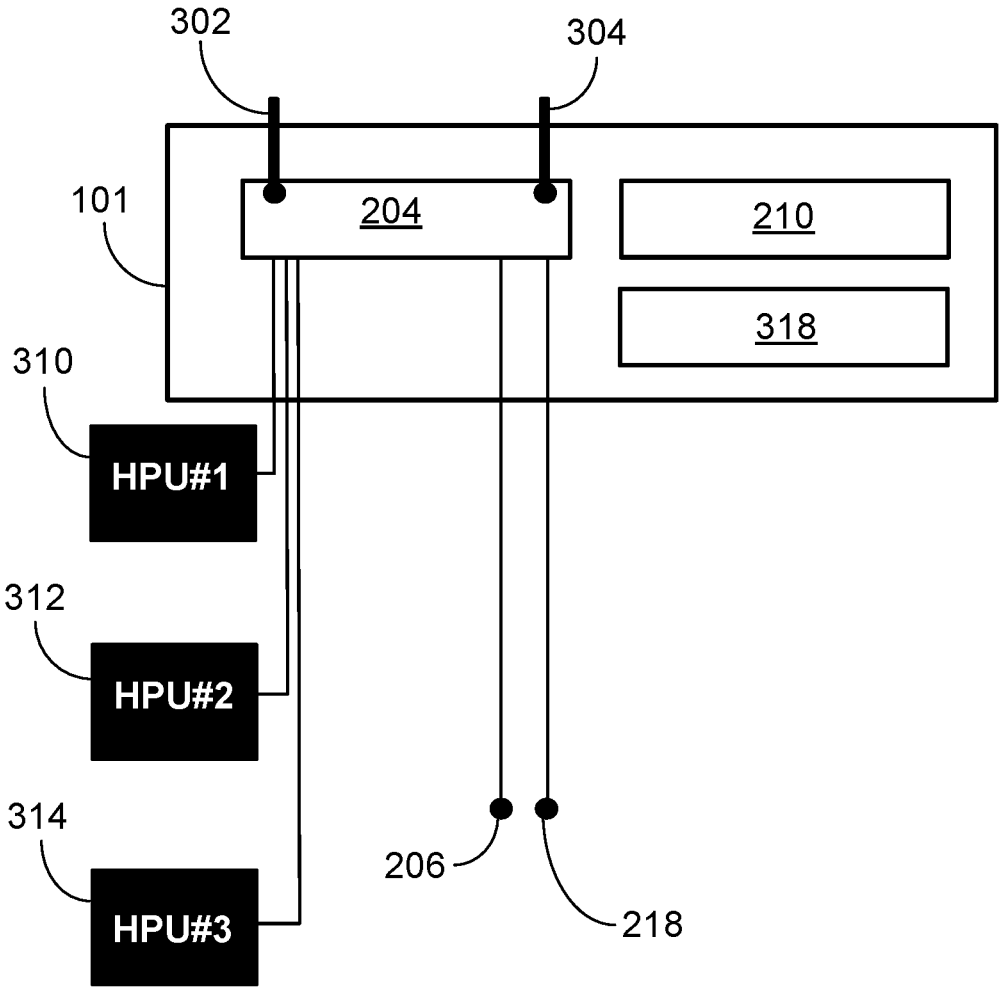
FIG. 3 shows a block diagram of an example control system.

The control sub-assembly 101 is positioned at one end of the packer sub-assembly 103 and can include a power source 210 and one or more processors 204. FIG. 3 shows a detailed block diagram of the control sub-assembly 101. The control sub-assembly 101 can include one or more processors 204 and a computer-readable medium 318 that stores instructions executable by the one or more processors 204 to perform operations. The one or more processors 204 are also coupled to the first annular pressure sensor 206 and the second annular pressure sensor 218. The one or more processors can determine a differential pressure between the first annular pressure sensor 206 and the second annular pressure sensor 218. In some implementations, more sensors can be used, and the one or more processors 204 can determine absolute pressures of the additional sensors or relative pressures between the additional sensor and any other sensor. The control sub-assembly 101 can also include a transmitter 302 and receiver 304 that can be used to receive, from the surface of the wellbore, sealing instructions to perform sealing operations within the wellbore, and transmit, to the packer sub-assembly 103, at least a portion of the sealing instructions. The receiver 304 can also receive, from the packer sub-assembly 103, status signals representing a sealing status of the packer sub-assembly 103. The transmitter 302 can also transmit the status signals to the surface 116 of the wellbore 106. The status signals can include a state of a sealing sub-assembly (such as an "on" state or an "off" state), a hydraulic pressure of the packer sub-assembly 103, or any other statuses.

The control sub-assembly also includes a power source 210 that can be positioned within the wellbore. The power source 210 can be operatively coupled to the one or more processors 204 and can provide operating power to the one or more processors 204. In some implementations, the power source can be a stand-alone power source positioned within the wellbore 106, such as a lithium ion battery (or other rechargeable power source). The packer installation system 100 can include one or more hydraulic power units, such as a first hydraulic power unit 310, a second hydraulic power unit 312, or a third hydraulic power unit 314, operatively coupled to the one or more processors 204. Any of the hydraulic power units can receive at least a portion of a set of sealing instructions from the one or more processors 204. The hydraulic power units may receive instructions to change states ("on" command or "off" command) of the hydraulic pump, set a target pressure for the hydraulic pump, or any other command that can be executed by the hydraulic power unit. In some implementations, the different hydraulic power units may be interconnected to allow fluidic communication between each hydraulic power unit. The interconnection can allow a hydraulic power unit to control multiple sealing sub-assemblies in the event of a hydraulic power unit failure. In some implementations, each hydraulic power unit can include its own one or more sensors, for example, a pressure sensor or other sensor. Each hydraulic power unit can receive measurements (or other information) sensed by its one or more sensors, and transmit the same to the control sub-assembly 101.

Figure 4B:
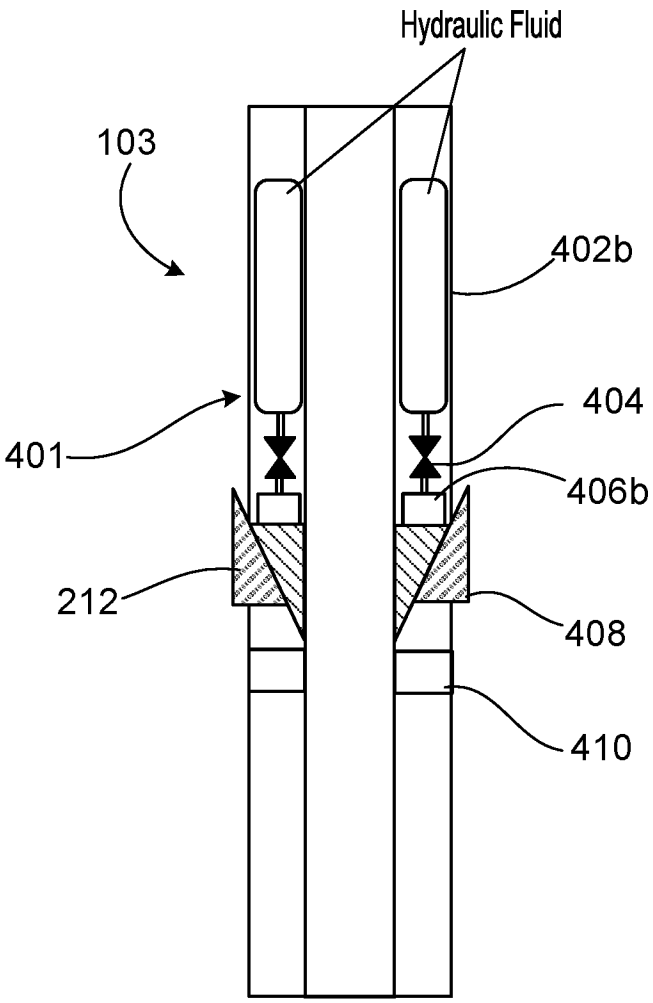
FIGS. 4A-4B show a side cross sectional view of an example packer slip (engage and disengage).
Figure 4A:
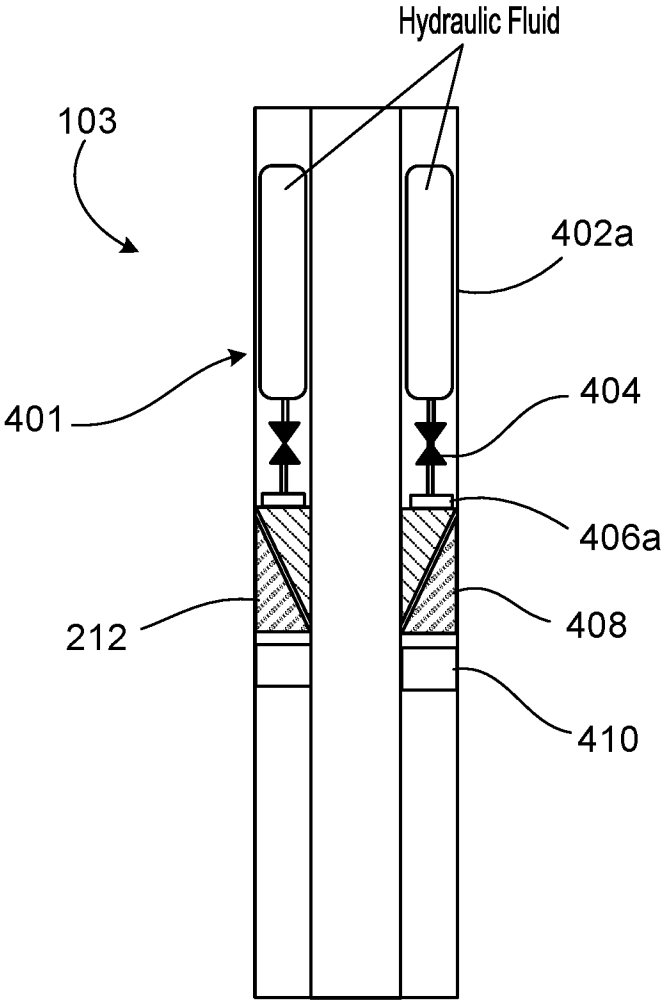

FIGS. 4A-4B show side cross-sectional views of a disengaged packer slip and an engaged packer slip, respectively. The illustrated implementation can be used for the first packer slip 212, the second packer slip 216, or any other packer slip. The packer sub-assembly 103 includes a hydraulic power unit 401 operatively coupled to the control sub-assembly 101. The hydraulic power unit 401 can act as one of the hydraulic power units previously described, such as the first hydraulic power unit 310. The hydraulic power unit 401 can receive at least a portion of the sealing instructions from the control sub-assembly 101. Portions of the sealing instructions can include changing states of the hydraulic pump, changing an output pressure of the hydraulic pump, changing position of an actuate-able tool, or any other command that can be executed by the hydraulic power unit. The first packer slip 212 can be operatively coupled to the hydraulic power unit 401, that is, the hydraulic power unit 401 can mechanically activate the packer sub-assembly 103 to begin a sealing operation within the wellbore 106 responsive to being activated by the control sub-assembly 101. For example, the hydraulic power unit 401 itself can include hydraulic pump 404 fluidically connected to the packer first packer slip 212. The hydraulic pump 404 can supply hydraulic fluid, such as the hydraulic fluid stored in a full hydraulic reservoir 402*a*, at a pressure sufficient to activate the packer sub-assembly 103. To activate the packer sub-assembly 103, the hydraulic power unit 401 can cause the packer first packer slip 212 to extend radially outward from the packer sub-assembly 103 and towards the wall of the wellbore 106. The extended packer first packer slip 212 bite into the wellbore and can at least partially support the packer sub-assembly 103 within the wellbore 106. The packer sub-assembly 103 can also include more sensors 410 to relay information back to the control sub-assembly 101, such as hydraulic pressure or packer slip 212 position.

Once the hydraulic power unit 401 has received a signal to activate the packer sub-assembly 103, the hydraulic pump 404 moves hydraulic fluid from a full hydraulic reservoir 402*a* to an unexpanded expansion member 406*a*. The unexpanded expansion member 406*a* begins to expand and become expanded expansion member 406*b*. Similarly, the full hydraulic reservoir 402*a* becomes the depleted hydraulic reservoir 402*b* during the activation of the packer sub-assembly 103. That is, activating at least one of the packing slips, such as the first packer slip 212, includes pumping hydraulic fluid to mechanically activate the respective packing slip with the hydraulic pump 404. The expanded expansion member 406*b* moves a wedged-shaped mandrel 408 towards the packer first packer slip 212. The wedge-shaped mandrel 408 causes the packer first packer slip 212 to extend radially outward from the packer sub-assembly 103 and towards the wall of the wellbore 106. Once sealing operations are completed, the control sub-assembly 101 can send a signal to the hydraulic pump 404 to pump hydraulic fluid from the expanded expansion member 406*b* back into the depleted hydraulic reservoir 402*b*. The packer sub-assembly 103 can include a retraction device, such as a spring, to return the wedge-shaped mandrel 408 and packer first packer slip 212 back into the retracted position once the hydraulic fluid has been removed from the expanded expansion member 406*b*. In some implementations, the hydraulic power unit 401 may be fluidically connected to a separate hydraulic power unit in another part of the packer sub-assembly 103. Such a connection allows for a single hydraulic power unit to control multiple components within the packer sub-assembly 103 in the event of a failure of one of the hydraulic power units, such as hydraulic power unit 401.

Figure 5B:
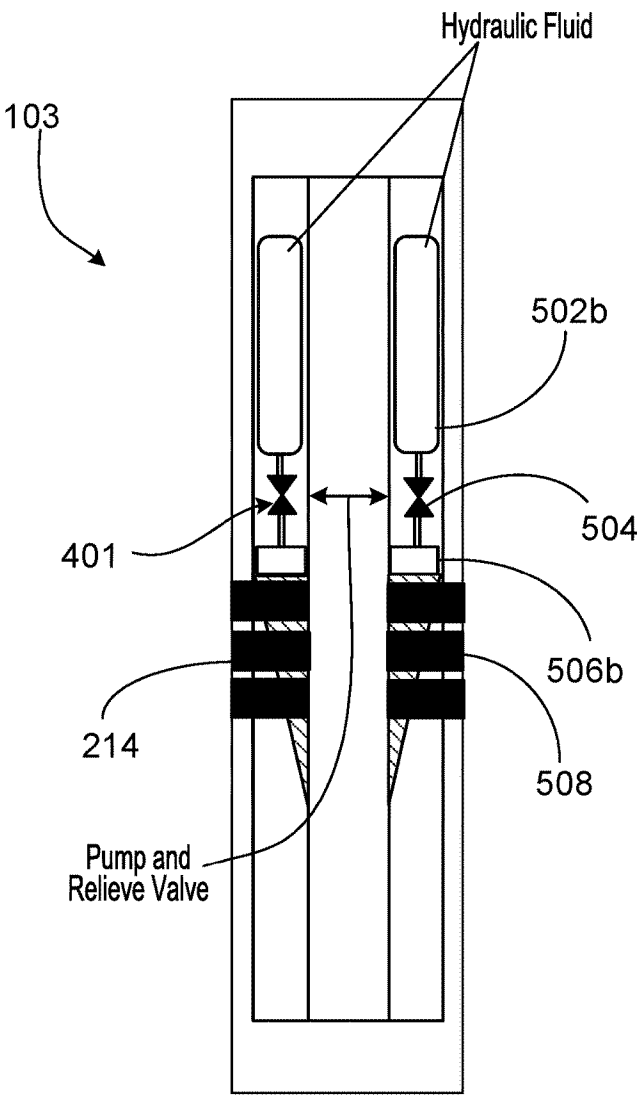
FIGS. 5A-5B show a side cross sectional view of an example packing element (engage and disengage).
Figure 5A:
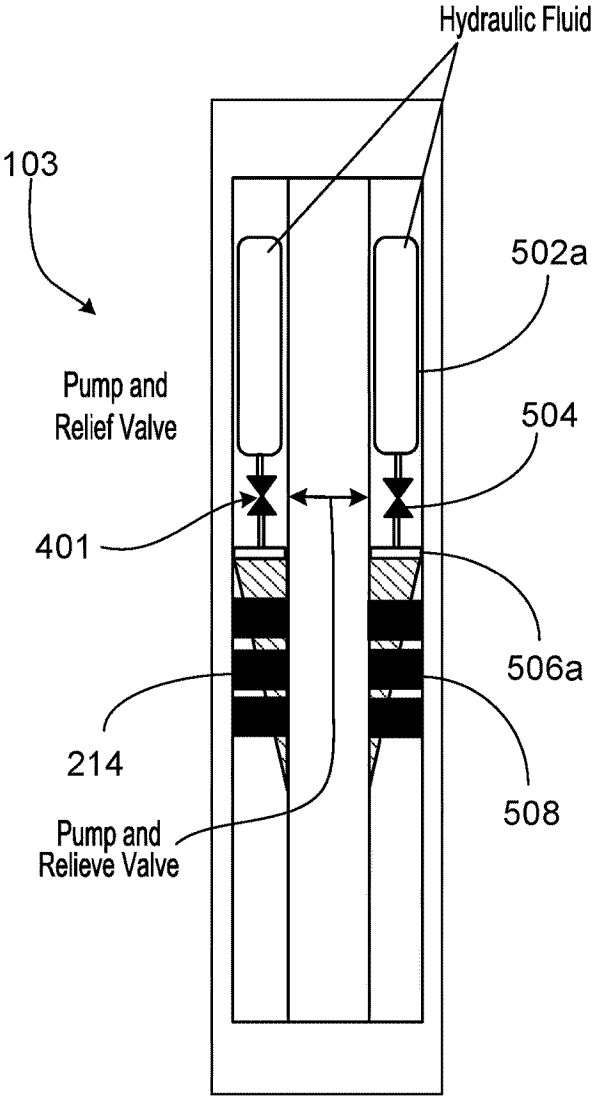

FIGS. 5A-5B show an example cross-sectional view of an example packing element 214 in various stages of operation. In FIG. 5A, the packing element 214 is in a disengaged mode, while in FIG. 5B, the packing element 214 is in an engaged mode. The packing element 214 includes a hydraulic power unit 501 operatively coupled to the control sub-assembly 101. The hydraulic power unit 501 can act as one of the hydraulic power units previously described, such as the second hydraulic power unit 312. The hydraulic power unit 501 can receive at least a portion of the sealing instructions from the control sub-assembly 101. Portions of the sealing instructions can include changing states of the hydraulic pump, changing an output pressure of the hydraulic pump, changing position of an actuate-able tool, or any other command that can be executed by the hydraulic power unit. The scraping tool can be operatively coupled to the hydraulic power unit 501, that is, the hydraulic power unit 501 can mechanically activate the packing element 214 to begin a sealing operation within the wellbore 106 responsive to being mechanically activated by the hydraulic power unit 501. For example, the hydraulic power unit 501 may cause the packing element 214 to extend radially outward from the packer sub-assembly 103 and towards the wall of the wellbore 106.

Once the hydraulic power unit 501 has received a signal to activate the packing element 214, the hydraulic pump 504 moves hydraulic fluid from a full hydraulic reservoir 502*a* to an unexpanded expansion member 506*a*. The unexpanded expansion member 506*a* begins to expand and become expanded expansion member 506*b*. Similarly, the full hydraulic reservoir 502*a* becomes the depleted hydraulic reservoir 502*b* during the activation of the packing element 214. The expanded expansion member 506*b* moves a wedged-shaped mandrel 508 towards packing element 214. The wedge shaped mandrel 408 causes the packing element 214 to extend radially outward from the packer sub-assembly 103 and towards the wall of the wellbore 106. In some implementations, the mandrel need not be wedge-shaped; instead, the mandrel can be flat and can radially expand the packing elements by compressing them laterally. Once sealing operations are completed, the control sub-assembly 101 can send a signal to the hydraulic pump to pump hydraulic fluid from the expanded expansion member 506*b* back into the depleted hydraulic fluid reservoir 502*b*. The packing element 214 can include a retraction device, such as a spring, to return the wedge-shaped mandrel 508 and packing element 214 back into the retracted position once the hydraulic fluid has been removed from the expanded expandable member 506*b*. In some implementations, the packing element 214 itself may act as the retraction device. In some implementations, the hydraulic power unit 501 may be fluidically connected to a separate hydraulic power unit in another part of the packer sub-assembly 103. Such a connection allows for a single hydraulic power unit to control multiple components within the packer sub-assembly 103 in the event of a failure of one of the hydraulic power units, such as hydraulic power unit 501.

Figure 6:
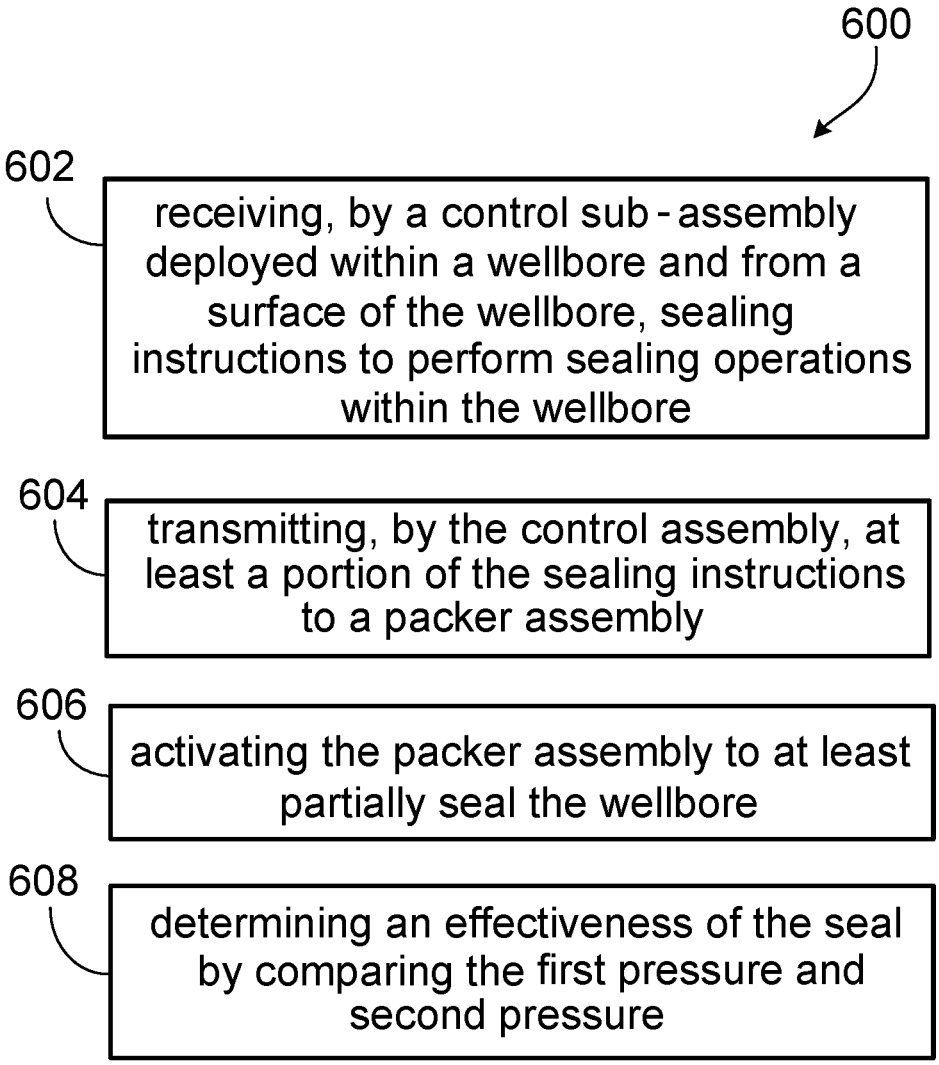
FIG. 6 is a flowchart showing an example method of controlling a packer sub-assembly.

FIG. 6 shows a flowchart of an example method 600 for controlling the packer sub-assembly 103. At 602, sealing instructions to perform sealing operations within the wellbore 106 are received by a control sub-assembly 101 deployed within a wellbore 106 from a surface 116 of the wellbore 106. At 604, at least a portion of the sealing instructions are transmitted to the packer sub-assembly 103 by the control assembly 101. At 606, the packer sub-assembly 103 is activated to at least partially seal the wellbore 106. At 608, an effectiveness of the seal is determined by comparing the first pressure and second pressure. If the seal is unsuccessful, the packer sub-assembly can actuate the packing element 214 at least one additional time to re-attempt a successful seal. The first slip 212 and the second packer slip 216 can also be actuated to re-attempt a successful seal. Alternatively, or in addition, an electronic diagnostic test can be implemented on the packer sub-assembly to evaluate the performance of all sensors and systems. After the packer sub-assembly 103 is activated, status signals representing a status of the packer sub-assembly 103 are transmitted from the packer sub-assembly 103 to the control assembly 101. The status signals are received by the control sub-assembly 101 from the packer sub-assembly 103. The control sub-assembly 101 transmits the status signals from the packer sub-assembly 103 to the surface 116 of the wellbore 106. If the seal fails after an extended period of time, a warning status can be transmitted to the surface and a successful seal can be re-attempted. Alternatively, or in addition, the seal can be de-activated and activated again. A proper operation of the packer sub-assembly 103 combined with improper sealing is an indication that the casing may have a leak, for example, due to excessive wear at that position or for some other reason. Activating the first packer slip 212, the second packer slip 216, and the packing element 214 attached the packer sub-assembly 103 to at least partially seal the wellbore 106 can include pumping hydraulic fluid with the hydraulic pump to mechanically activate the first packer slip 212, the second packer slip 216, or the packing element 214.

Figure 7:
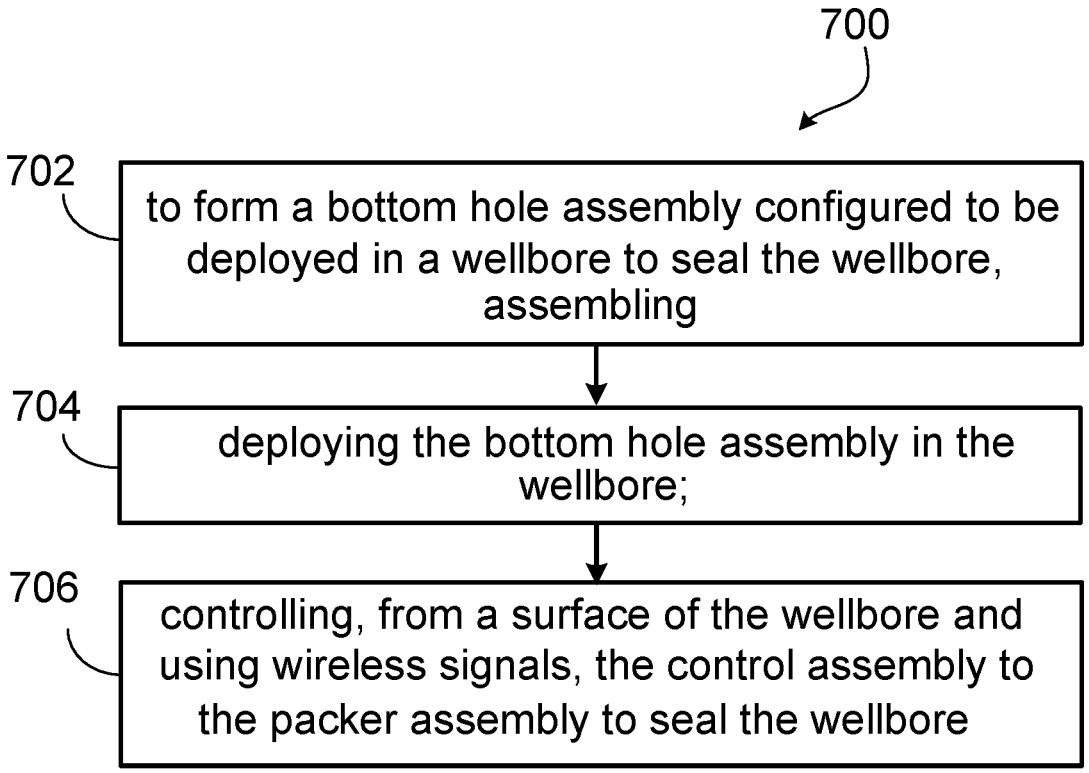
FIG. 7 is a flowchart showing an example method of utilizing a packer sub-assembly.

FIG. 7 shows a flowchart of an example method 700 for utilizing the packer sub-assembly 103. At 702, components that are capable of being deployed in a wellbore are assembled to form a bottom hole assembly 102 to seal the wellbore 106. The components can include a control sub-assembly 101 with the one or more processors 204 and a computer-readable medium 318 storing instructions executable by the one or more processors 204 to seal the wellbore 106, and a packer sub-assembly 103 to seal a wellbore 106. At 704 the bottom hole assembly 102 is deployed in the wellbore 106. At 706, the control sub-assembly 101 is controlled from the surface 116 of the wellbore 106 using wireless signals to engage the packer sub-assembly 103 to seal the wellbore 106. Status signals representing a status of sealing operations are received by the control sub-assembly 101 and from the packer sub-assembly 103. The status signals are wirelessly transmitted by the control sub-assembly 101 and to the surface 116 of the wellbore 106. The status signals can include a state of the packer sub-assembly 103, such as an "on" state or an "off" state, a hydraulic pressure of the packer sub-assembly, a differential pressure across the packer sub-assembly, or any other status.

Particular implementations of the subject matter have been described. Other implementations are within the scope of the following claims.

What is claimed is:

1. A wellbore monitoring system comprising:

a first packer slip to at least partially support the system;

a second packer slip configured to at least partially support the system;

a packing element configured to at least partially seal an uphole portion of a wellbore from a downhole portion of the wellbore;

a first annular pressure sensor positioned uphole of the packing element, the first annular pressure sensor configured to measure a first pressure within the wellbore uphole of the packing element;

a second annular pressure sensor positioned downhole of the packing element, the second annular pressure sensor configured to measure a second pressure within the wellbore downhole of the packing element;

a first hydraulic power unit, a second hydraulic power unit and a third hydraulic power unit connected to the first packer slip, the second packer slip and the packing element, respectively; and a control sub-assembly configured to be positioned within the wellbore, the control sub-assembly configured to monitor a sealing efficiency of the system by comparing the first pressure and the second pressure, the control sub-assembly connected to each of the first hydraulic power unit, the second hydraulic power unit and the third hydraulic power unit, the first hydraulic power unit, the second hydraulic power unit and the third hydraulic power unit configured to activate the first packer slip, the second packer slip and the packing element, respectively, in response to receiving instructions from the control sub-assembly.

2. The system of claim 1 further comprising:

a cylindrical body that supports the packing element, the first annular pressure sensor, the second annular pressure sensor, and the control sub-assembly, wherein the first packer slip is positioned nearer an uphole end of the cylindrical body than a downhole end of the cylindrical body, and wherein the second packer slip is positioned nearer the downhole end of the cylindrical body than the uphole end of the cylindrical body.

3. The system of claim 2 wherein the packing element is positioned between the first packer slip and the second packer slip.

4. The system of claim 2, wherein the control sub-assembly comprises:

one or more processors; and a computer-readable medium storing instructions executable by the one or more processors to perform operations comprising:

receiving, from a surface of the wellbore, instructions to perform sealing operations within the wellbore; and transmitting to the control sub-assembly at least a portion of the sealing instructions, the packing element at least partially sealing the wellbore in response to the sealing instructions.

5. The system of claim 4, wherein the operations further comprise:

receiving, from at least one of annular pressure sensors, status signals representing a sealing status of the packing element; and transmitting, to the surface of the wellbore, the status signals.

6. The system of claim 5, wherein the status signals comprise a state of the system, the state comprising either an engaged or a disengaged state, wherein an engaged state comprises the first slip being in an extended position, the second slip being in an extended position, or the packing element being in an extended position, an extended position comprising extending from the cylindrical body to a wall of the wellbore, and wherein a disengaged state comprises the first packing slip, the second packing slip, and the packing element to not extend from the cylindrical body to the wall of the wellbore.

7. The system of claim 6, further comprising:

one or more transmitters at the surface of the wellbore, the one or more transmitters configured to transmit the sealing instructions to the one or more processors; and one or more receivers at the surface of the wellbore, the one or more receivers configured to receive the status signals from the one or more processors.

8. The system of claim 7, wherein the one or more transmitters and the one or more receivers are configured to communicate wirelessly with the one or more processors.

9. The system of claim 8, further comprising one or more repeaters configured to be positioned between the surface and the control sub-assembly within the wellbore, the one or more repeaters configured to boost a strength of a wireless signal between the one or more transmitters or the one or more receivers and the one or more processors.

10. The system of claim 4, wherein the control sub-assembly further comprises a power source configured to be positioned within the wellbore, the power source operatively coupled to the one or more processors, the power source configured to provide operating power to the one or more processors.

11. The system of claim 10, wherein the power source is a stand-alone power source.

12. The system of claim 4, wherein each of the first hydraulic power unit, the second hydraulic power unit and the third hydraulic power unit is operatively coupled to the one or more processors and is configured to receive at least the portion of the instructions from the one or more processors.

13. The system of claim 12, wherein each of the first hydraulic power unit, a second hydraulic power unit and a third hydraulic power unit comprises a hydraulic pump fluidically connected to the system, the hydraulic pump configured to supply hydraulic fluid at a pressure sufficient to activate the system.

14. The system of claim 1, wherein the first hydraulic power unit, the second hydraulic power unit and the third hydraulic power unit are fluidically connected to each other to allow fluidic communication between the three hydraulic power units.

15. A method of sealing a wellbore, the method comprising:

receiving, by a control sub-assembly deployed within a wellbore and from a surface of the wellbore, sealing instructions to perform sealing operations within the wellbore;

transmitting, by the control assembly, at least a portion of the sealing instructions to a packer sub-assembly comprising:

a cylindrical body;

a first packer slip positioned nearer an uphole end of the cylindrical body than a downhole end of the cylindrical body, the first uphole packer slip configured to at least partially support the packer sub-assembly;

a second packer slip positioned nearer the downhole end of the cylindrical body than the uphole end of the cylindrical body, the second packer slip configured to at least partially support the packer sub-assembly;

a packing element positioned between the first packer slip and the second packer slip, the packing elements configured to at least partially seal a wellbore;

a first hydraulic power unit, a second hydraulic power unit and a third hydraulic power unit connected to the first packer slip, the second packer slip and the packing element, respectively;

a first annular pressure sensor positioned uphole of the packing element, the first annular pressure sensor configured to measure a first pressure within the wellbore uphole of the packing element;

a second annular pressure sensor positioned downhole of the packing element, the second annular pressure sensor configured to measure a second pressure within the wellbore downhole of the packing element;

interconnecting the first hydraulic power unit, the second hydraulic power unit and the third hydraulic power unit to allow fluidic communication between the three hydraulic Power units;

activating the packer sub-assembly to at least partially seal the wellbore by activating the first hydraulic power unit, the second hydraulic power unit and the third hydraulic power unit to activate the first packer slip, the second packer slip and the packing element, respectively; and determining an effectiveness of the seal by comparing the first pressure and second pressure.

16. The method of claim 15, further comprising:

transmitting, by the packer sub-assembly to the control assembly, status signals representing a status of the packer sub-assembly; and receiving, by the control assembly, the status signals from the packer sub-assembly.

17. The method of claim 16, further comprising transmitting, by the control assembly to the surface of the wellbore, the status signals from the packer sub-assembly.

18. The method of claim 15, wherein each of the first hydraulic power unit, the second hydraulic power unit and the third hydraulic power unit comprises a hydraulic pump, wherein activating, by the first hydraulic power unit, the second hydraulic power unit and the third hydraulic power unit, the first packer slip, the second packer slip, and the packing element, respectively, to at least partially seal the wellbore comprises pumping, by each hydraulic pump, hydraulic fluid to mechanically activate the respective first packer slip, the second packer slip, and the packing element.

19. A method comprising:

to form a bottom hole assembly configured to be deployed in a wellbore to seal the wellbore, assembling:

a control assembly comprising one or more processors and a computer-readable medium storing instructions executable by the one or more processors to seal the wellbore; and a packer sub-assembly to seal a wellbore, the packer sub-assembly comprising:

a cylindrical body;

a first packer slip positioned nearer an uphole end of the cylindrical body than a downhole end of the cylindrical body, the first uphole packer slip configured to at least partially support the packer sub-assembly;

a second packer slip positioned nearer the downhole end of the cylindrical body than the uphole end of the cylindrical body, the second packer slip configured to at least partially support the packer sub-assembly;

a packing element positioned between the first packer slip and the second packer slip, the packing elements configured to at least partially seal a wellbore;

a first hydraulic power unit, a second hydraulic power unit and a third hydraulic power unit connected to the first packer slip, the second packer slip and the packing element, respectively;

deploying the bottom hole assembly in the wellbore; and controlling, from a surface of the wellbore and using wireless signals, the control assembly to the packer sub-assembly to seal the wellbore by transmitting at least a portion of a set of sealing instructions to each of the first hydraulic power unit, the second hydraulic power unit and the third hydraulic power unit to activate each of the first packer slip, the second packer slip and the packing element, respectively.

20. The method of claim 19, further comprising:

receiving, by the control assembly and from the packer sub-assembly, status signals representing a status of sealing operations; and wirelessly transmitting, by the control assembly and to the surface of the wellbore, the status signals.

21. The method of claim 20, wherein the status signals comprise a state of the packer sub-assembly, the state comprising either an on state or an off state, and a hydraulic pressure of the packer sub-assembly.

22. The method of claim 20, wherein the status signals comprise a pressure differential across the packer sub-assembly.

23. The method of claim 19, further comprising interconnecting the first hydraulic power unit, the second hydraulic power unit and the third hydraulic power unit to allow fluidic communication between the three hydraulic power units.

* * * * *